United States Patent [19]

Baumann et al.

[11] 4,170,349

[45] Oct. 9, 1979

[54] SELF-CONTAINED MOTOR-DRIVEN COLLATOR DEFLECTOR

[75] Inventors: Gerald W. Baumann, Boulder, Colo.; Joseph L. Gambrell, Lexington, Ky.; George F. Hayes, Niwot, Colo.; Francis J. Schell; Allen G. Schulte, both of Boulder, Colo.

[73] Assignee: International Business Machines Corporation, Armonk, N.Y.

[21] Appl. No.: 863,207

[22] Filed: Dec. 22, 1977

[51] Int. Cl.[2] ..... B65H 29/60; B65H 31/24

[52] U.S. Cl. ..... 271/296; 271/314; 271/270

[58] Field of Search ..... 271/173, 64, 80, 270, 271/202, 203, 69; 270/58; 355/3 SH

[56] References Cited

U.S. PATENT DOCUMENTS

| | | | |
|---|---|---|---|
| 1,237,646 | 8/1917 | Hollerith . | |
| 2,076,391 | 4/1937 | Whitehead | 271/64 |
| 2,328,317 | 8/1943 | Wentworth | 271/64 X |
| 2,661,209 | 12/1953 | McGalliard | 271/173 |
| 3,879,032 | 4/1975 | Shirahase | 271/173 X |
| 3,954,367 | 5/1976 | Ambler et al. | 271/69 X |
| 3,977,667 | 8/1976 | Cross et al. | 271/173 X |
| 4,141,546 | 2/1979 | Queener | 271/173 |

*Primary Examiner*—Bruce H. Stoner, Jr.
*Attorney, Agent, or Firm*—Charles E. Rohrer

[57] ABSTRACT

A movable self-contained deflector unit for directing sheets into the paper bin of a multi-bin collator. A first motor is mounted on the frame of the deflector unit to drive transport rolls also mounted thereon. The transport roll provides the final impetus for moving the sheets into the collator bin. A second motor is mounted on the frame of the deflector unit to drive the unit to a selected bin. The motor may be reversible in order to approach a selected bin from either direction. Alternatively, movement of the deflector unit in the second direction may be obtained through a spring motor wound through deflector unit movement in the first direction. Speed of the spring-driven deflector unit is controlled by dynamic braking of the second motor. This collator may interact with a copier machine to provide semi-automatic duplexing and the speed of the transport rolls may be synchronized with the speed of the copier for moving copy sheets into bins while the sheet is still in the final processing station. The speed of the transport rolls is increased when the sheet leaves the final processing station.

15 Claims, 7 Drawing Figures

SELF-CONTAINED MOTOR-DRIVEN COLLATOR DEFLECTOR

This invention relates to a sheet deflector unit in a collator and more particularly to the provision of independent electric motors, one to move the deflector unit in juxtaposition to a selected bin and one to move transport rolls in or out of synchronism with the speed of a machine to which the collator may be attached.

RELATED PATENT APPLICATIONS

This patent application represents an improvement on the invention described in U.S. patent application Ser. No. 778,765; filed Mar. 17, 1977, now abandoned, which patent application is incorporated herein by reference. This invention is designed to provide a reliable and inexpensive means for the deflection of sheets in a collator of small size which may be incorporated into a compact copier/collator combination. Such a combination is described in U.S. patent application Ser. No. 785,719; filed Apr. 7, 1977, now U.S. Pat. No. 4,141,546, which is also incorporated by reference.

BACKGROUND OF THE INVENTION

Prior art collator designs have been based upon several distinct approaches. One such approach is to employ a separate deflector at each document-receiving bin for intercepting documents transported along a path across the bin openings. Examples of multiple deflector devices are shown in U.S. Pat. Nos. 1,237,646 and 2,661,209. The prior art multiple deflector collator/-sorters are useful for high-speed and/or random-sequence sorting but are expensive to construct and, unless carefully designed and manufactured, are frequently unreliable in operation because of the large number of moving parts.

Other prior art approaches include bins either linearly or rotationally moved relative to a fixed location document distributor. These devices suffer from the disadvantage of having a relatively large mass which must be quickly and accurately moved. Thus, the relatively slow speed of operation and complexity of mechanisms are significant disadvantages for such apparatus. Yet another prior art approach is to employ an elongated document distributor pivoted around a point to form a path to the bin openings as shown in U.S. Pat. No. 2,076,391. The pivoted distributor approach is not well suited for reasonably usable numbers of receiving bins, especially since the size of the device becomes unacceptable for convenience copier environments.

Finally, single-moving deflector collators have been developed which have reasonable operating speed and reliability for many applications. An example of this approach is taught by prior art U.S. Pat. No. 2,328,317 which describes a large collator adapted for collating sheets or distributing similar objects into a multiple-shelved receiver. These receptacle shelves or bins are arranged in spaced parallel relation to each other forming a column or stack. All bin openings or mouths are ordered in a straight course or path, along which the articles to be distributed are transported by a conveyor system composed of continuous or cloed loop belts. The documents to be collated are positively retained between these continuous belts for transport along the straight course. This conveyor system is continuously driven by a first motor mounted to the frame of the collator. To divert or deflect the articles to be distributed into the respective bins, a single deflector assembly is operatively associated with the conveyor and is mounted for movement along the conveyor in the same path as the articles along the entrance mouths of the bins. Movement of this deflector assembly is accomplished by a cable system driven over a reversing clutch by a second motor mounted to the collator frame. An indexing mechanism controls positioning of the deflector assembly at predetermined positions along the conveyor path or course for deflecting moving documents therefrom into selected ones of the receiver shelves. Since the documents or articles to be collated are positively held by the belt-like conveyor system up to the openings of the slightly sloped shelves, the apparatus is substantially independent of particular horizontal or vertical orientations of the device.

While the movable deflector mechanism described in U.S. patent application Ser. No. 778,765; filed Mar. 17, 1977, named above, operates well, it employs numerous gears and other parts which provide weight and noise to the configuration. Since the collator is for special use on office copier machines, it is desirable to eliminate as much noise as possible since they are found in office environments. It is an advantage of the present invention that numerous parts and corresponding weight in the collator mechanism have been eliminated with a concomitant reduction in the amount of noise provided from the collator. Additionally, the collator design found in the above-mentioned patent application, when used with an office copier machine, is somewhat dependent upon long paper paths in which the sheet of copy paper has left the final processing station of the machine before it reaches the collator area. In that manner, transport means within the collator for feeding the copy sheet into the collator bins can be operated at a speed substantially higher than the speed at which the copy paper moves through the processing stations. Such a speed differential is desirable because it enables the copy sheets to be accelerated into a bin so that the movable deflector has additional time to move to the next bin and can be accurately positioned well before the next sheet of copy paper arrives from the machine. The provision of machine independent speed for the transport means also creates the capability of matching the speed to the requirement of pushing the paper into the receiving bin at an optimum velocity. This invention is designed to accomplish a similar result in a machine with a short paper path in which the paper has already entered the area of the transport means at a time in which it is still in a machine processing station. In such a machine, the transport means should be operated at machine speed while the paper is still within machine processing stations, but should be accelerated to an optimum paper-expelling speed once the paper is out of the last processing station. This invention provides an independent, multiple-speed drive for the transport rolls.

Another disadvantage of the collator described in U.S. patent application Ser. No. 778,765; filed Mar. 17, 1977, is that it can move to the appropriate bin from one direction only. In a copier machine in which it is desired to produce duplexed copies by manually removing the single-sided sheets from the collator and placing those sheets in the paper drawer upside down so that the second side can be copied on the blank side of the first copy, the one-direction only collator creates problems. Note that the collator "backstacks" copy paper, i.e., the first sheet entering the vertical collator bin is positioned nearest the machine from which it came. Backstacking is advantageous since the result is side one on top when papers are removed from the bins. However, when producing duplexed copies, it is desirable to move the deflector backwardly on the first pass, i.e., to move the deflector from what would normally be bin 10, for example, toward bin 1. In that manner side one can be stacked in bin 10, side three can be stacked in bin 9, side five in bin 8, etc. As a consequence, when the operator of the machine removes the paper from the collator, all the blank sides of sheet one will be on top and will be so positioned in the copy paper bin. Therefore, the blank sides of sheet ones are fed into the machine first to receive an imprint of side two. In that manner the operator is not required to feed the original documents in reverse order on the second pass. Unfortunately, the deflector mechanism described in the above-mentioned patent application is incapable of moving to a selected bin from either direction. This invention solves that problem by providing a simple and light-weight, noise-free, low-cost deflector mechanism capable of selecting bins while moving in either direction by providing an independent electric motor to move the deflector in either an incrementing or decrementing direction, or both.

SUMMARY OF THE INVENTION

This invention involves a collator/sorter with a self-contained deflector unit capable of selecting one of a number of collator bins while moving from either direction. In that manner, paper may be stacked in forward order or in reverse order. A motor is provided, mounted on the frame of the movable deflector unit to move the unit in either direction. If desired, a torque spring may be used to move the deflector unit in one direction while the motor moves the unit in the other. Additionally, a second multiple-speed motor is mounted on the frame to drive transport rolls also mounted on the frame. These rolls provide the final impetus to the sheet of copy paper moving from the deflector into the collator bins. An additional feature of the invention is that the speed of the second motor may be synchronized with the speed of a processing unit such as a convenience copier machine, without disturbing the speed of the first motor in driving the deflector unit from bin to bin.

BRIEF DESCRIPTION OF THE DRAWINGS

The above-mentioned and other features and objects of this invention and the manner of attaining them will become more apparent and the invention itself will best be understood by reference to the following description of embodiments of the invention taken in conjunction with the accompanying drawings, the description of which follows.

DETAILED DESCRIPTION

Figure 1:
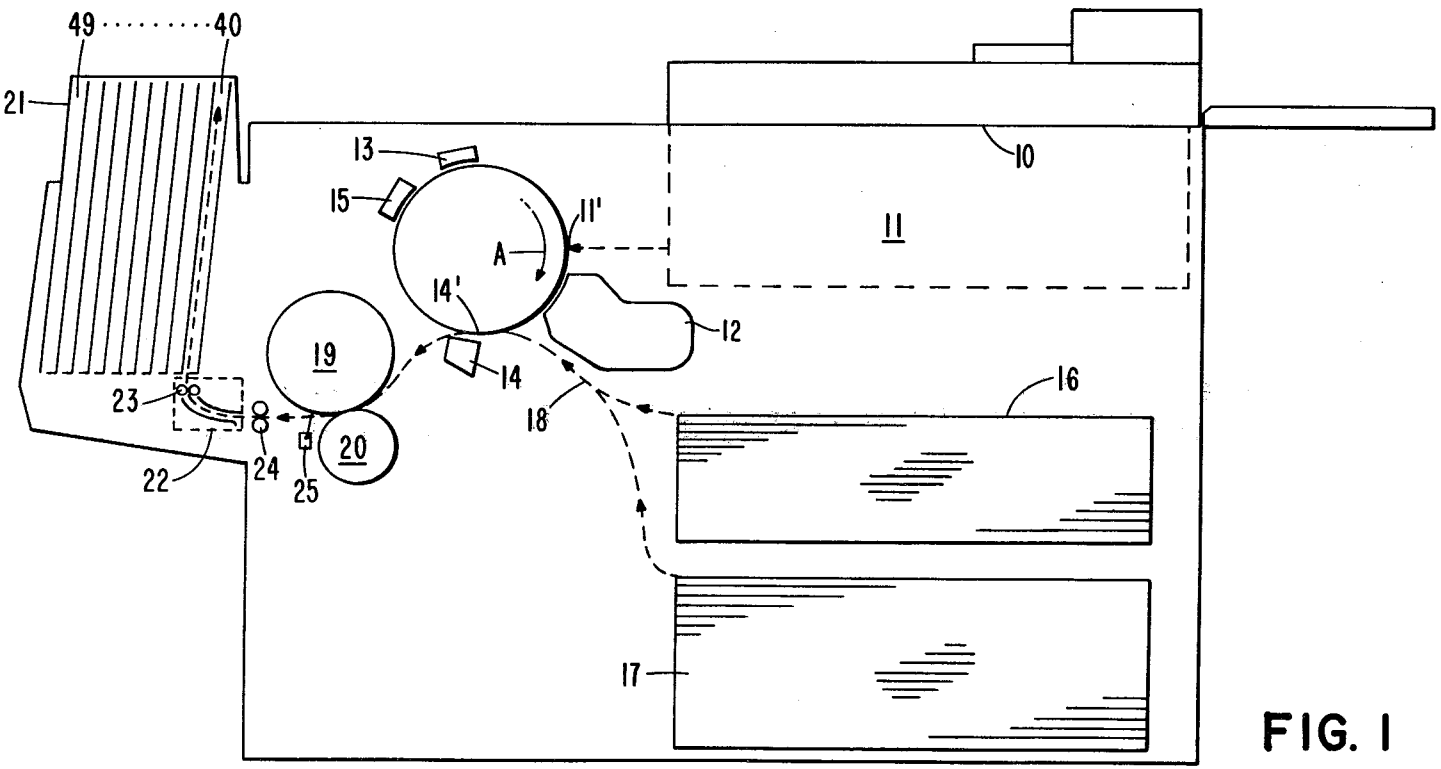
FIG. 1 shows a schematic view of the paper path of a convenience copier machine incorporating a collator/sorter.

FIG. 1 shows a diagrammatic drawing of an electrophotographic copier machine of the transfer type which will be used to describe an embodiment for the instant invention. In a machine of this type an original document is placed on a document glass 10 whereat it is imaged through the use of an illumination and optical system shown generally at 11. The resultant image is impressed upon a photoconductive drum at imaging station 11' and is developed at a developing station by developer 12.

Prior to receiving the image of the document of imaging station 11' the photoconductor received a uniform charge from charging corona 13. The result of imaging the charged photocondutor is to discharge the photoconductor at all areas at which light is directed, different shades of light resulting in different degrees of discharge. The developing material placed on the image at developing station 12 is variably deposited on the latent image according to the degree to which the photoconductor has been discharged. As the photoconductor continues to rotate in the direction A the developed image thereon is transferred to a sheet of copy paper at transfer station 14', under the influence of transfer corona 14. The photoconductor continues to rotate after transfer through a preclean corona 15 and to a cleaning station, not shown but which may be combined with developing station 12 if desired. Copy paper is fed from either bin 16 or bin 17 along paper path 18 to the transfer station 14' where the leading edge of the copy paper is mated with the leading edge of the developed image. After transfer, the copy paper continues to move along the copy paper path into a fusing station represented by rolls 19 and 20. At the fusing station the developer material which has been transferred to the copy paper is fused thereto. After leaving the fusing station the paper continues into one of the bins of collator 21. The selected bin is determined by the position of a movable deflector unit 22. Transport rolls 23 are carried by the movable deflector unit and positioned adjacent to openings in each of the collator bins. Exit roll means 24 are shown in FIG. 1 together with a paper sensing switch 25 located near the exit of a fusing station. Switch 25 is designed to sense the presence of a paper leaving the fusing station and when the paper is completely removed from the fusing station enables transport rolls 23 to increase in speed. While the paper is still in the fusing station the rolls 23 are rotated at a linear speed which matches the speed of the paper through the fusing station in order to avoid scrubbing on the surface of the paper which causes roll wear and builds up electrostatic charge on the paper.

Figure 2:
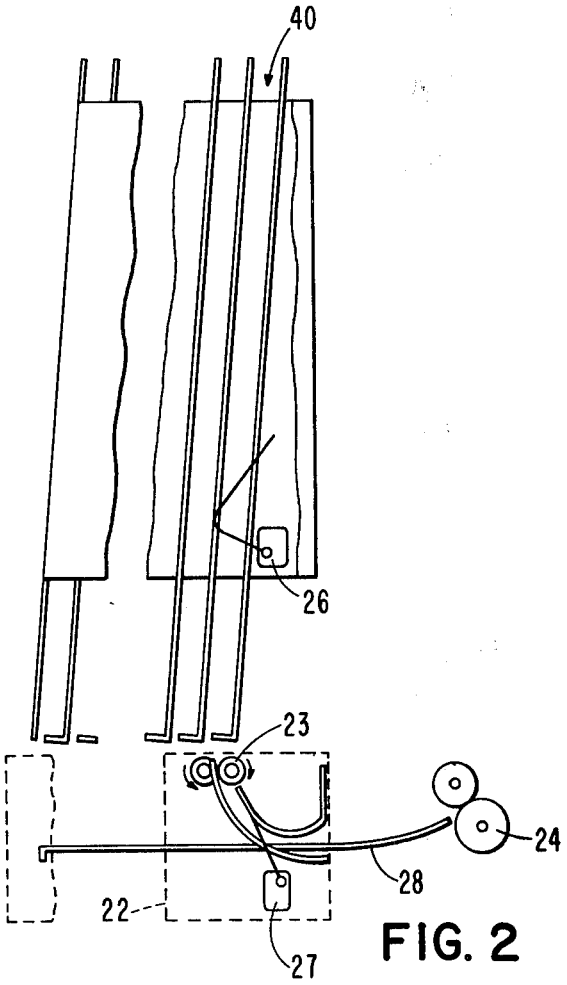
FIG. 2 shows a partial side view of the collator bins and the deflector unit of the instant invention.

FIG. 2 shows a side view of the collator bins. The first bin 40 contains a switch 26 which determines the presence or absence of any paper in the first bin 40. Note also a sheet-detecting switch 27 mounted in the deflector unit 22. Switch 27 is designed to detect the presence of a sheet of copy paper in the deflector unit and will signal the presence of a paper jam if the switch is thrown for too long a period of time. Exit rolls 24 are shown together with a stationary rail 28 which guides the paper into the movable deflector unit 22. The transport rolls 23 are also shown together with their direction of movement.

Figure 3:
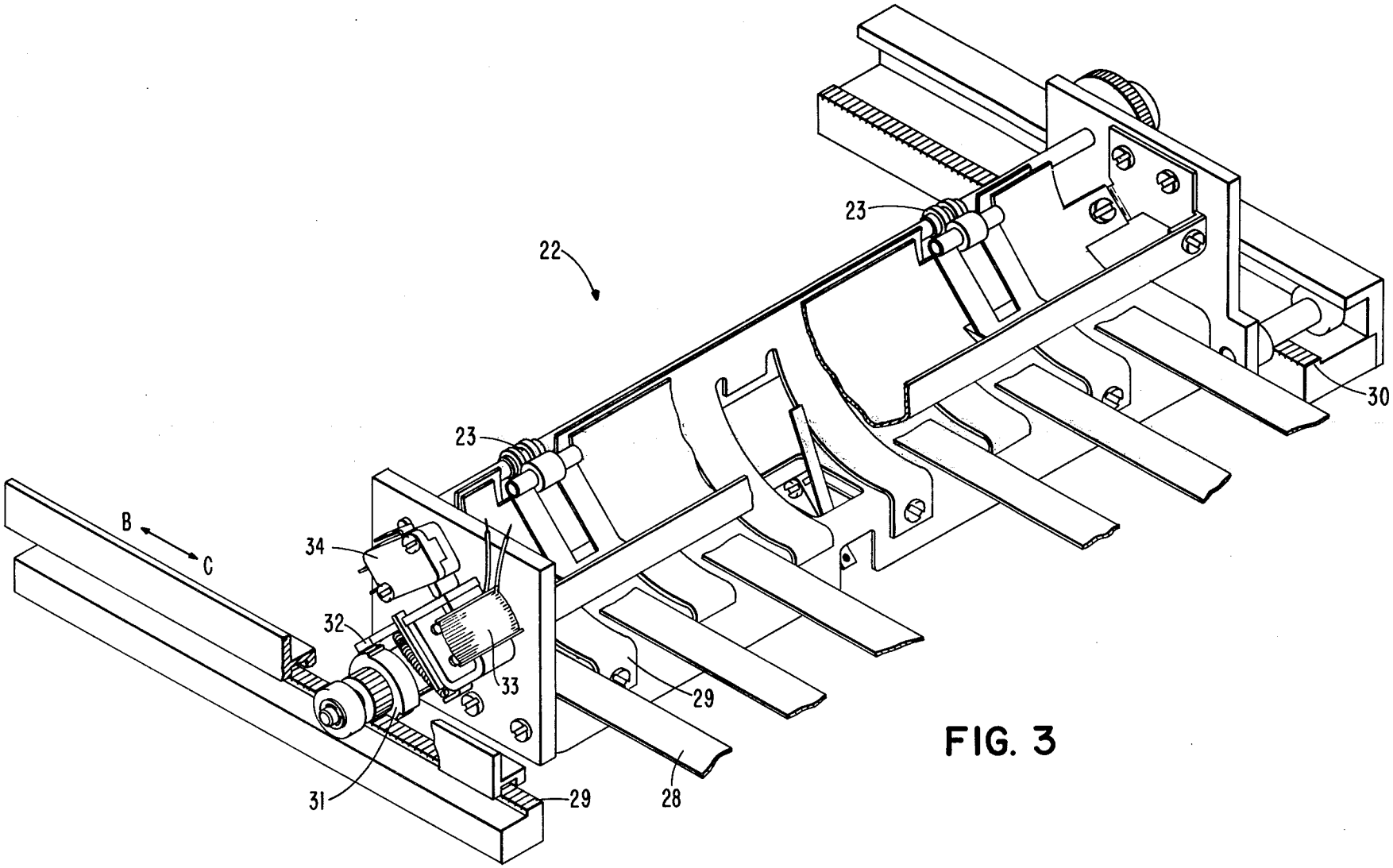
FIG. 3 is a view in perspective of the movable deflector unit.

FIG. 3 is a perspective drawing of the deflector unit 22. Paper enters the deflector unit along the top side of guide rails 28 of which six are shown in FIG. 3. As the leading edge of the paper moves along the guide rails 28 it moves into the curve of rails 29 of which there are six shown in FIG. 3. The paper is then deflected along the top surface of guide rails 29 into transport rolls 23 of which there are two shown in FIG. 3.

Deflector unit 22 is moved in either direction B or direction C along racks 29 and 30. The deflector unit is positioned under the opening of one of the collator bins by halting the deflector unit against one of the stop edges of ratchet 31. When motion is desired in direction B the cooperating dog 32 is lifted away from the ratchet 31 by solenoid 33. If motion is desired in direction C ratchet 31 may be turned without energization of solenoid 33. Note that whenever dog 32 reaches a high point of ratchet 31 switch 34 is released, signalling the approach of a stop edge of ratchet 31. In that manner, switch 34 tracks the advance of ratchet 31 and through that mechanism it enables the machine logic control to track the number of the bin at which the deflector unit 22 is at.

Figure 4:
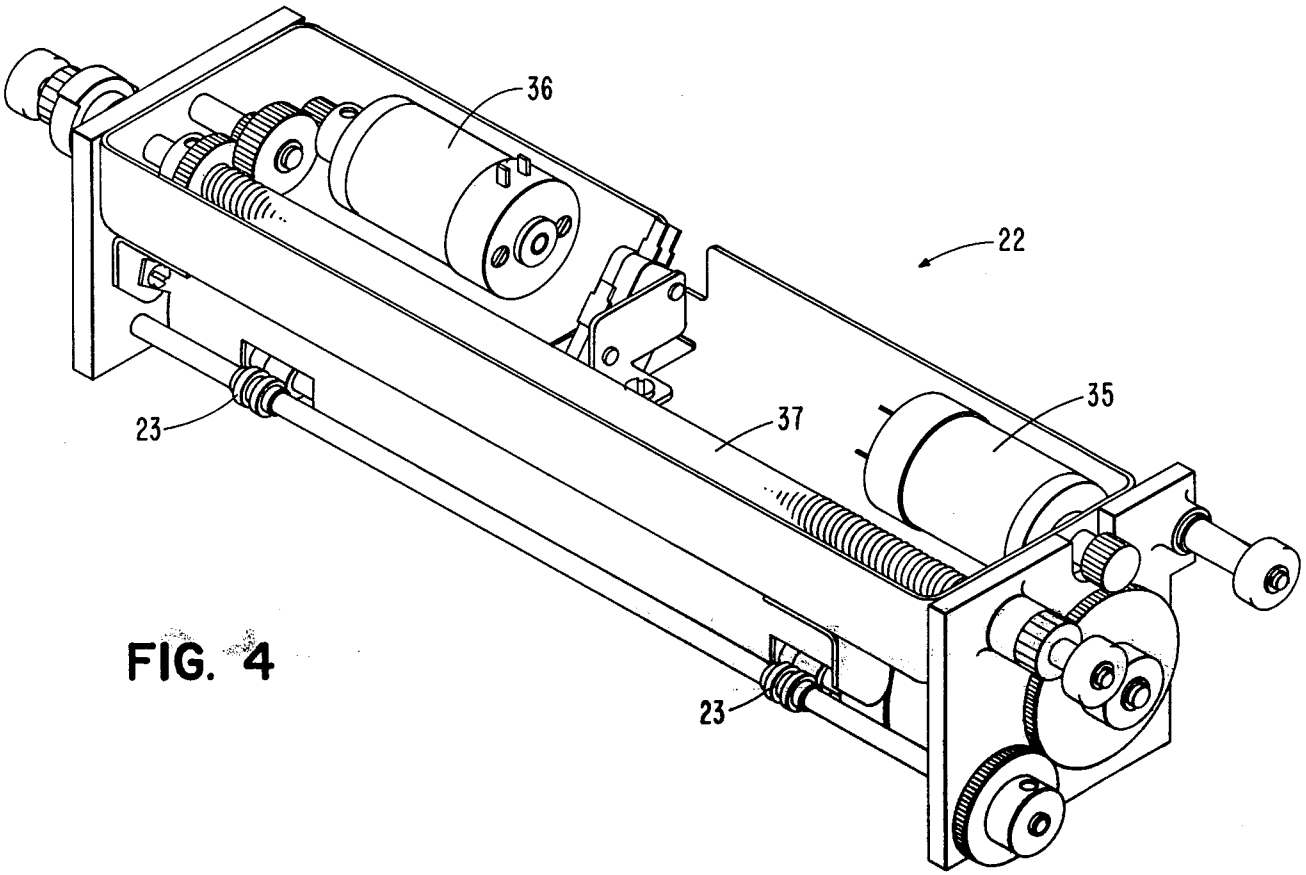
FIG. 4 is a view in perspective of the underside and the rear of the movable deflector unit.

FIG. 4 is a perspective view of the underside of deflector unit 22. This view shows an electric motor 35 which drives the transport rolls 23 through a succession of gears. This view also shows the electric motor 36 which drives the deflector unit 22 along the racks 29 and 30. The embodiment chosen for illustration shows a torque spring 37 which is wound by motor 36 as the deflector unit 22 moves in direction B. The torque spring is then used as a motor to move the unit 22 in a decrementing direction C. This is accomplished by energizing solenoid 33 to lift dog 32 away from ratchet 31. If it is desired to decrement the unit one bin, solenoid 33 is pulsed. Were it desired to move the deflector unit 2 from bin 49 to bin 40 without stopping at the inbetween bins solenoid 33 is held in an energized state throughout the movement of the deflector unit in direction C. If desired, unit 22 can be moved slightly beyond bin 40 to a stop and motor 36 then energized to position the deflector unit 22 directly under bin 40. It should be observed that when the torque spring 37 is used to supply a decrementing movement from bin 49 all the way to bin 40, a braking mechanism must be provided to control speed. This function is performed by motor 36 acting as a dynamic brake with the extent of the braking force set by the value of resistor 60 shown in FIG. 5.

Figure 5:
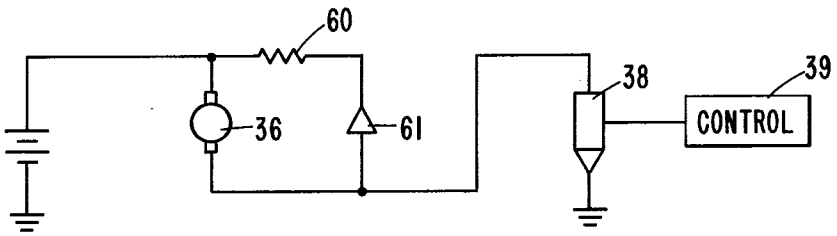
FIG. 5 is a circuit representation for supplying the incrementing motor to move the deflector unit in one direction.

FIG. 5 is an electrical schematic circuit for energizing motor 36 to move deflector unit 22 in direction B. Motor 36 is energized through transistor switch 38 by the control unit 39. Note that a dynamic braking loop is provided through resistor 60 and diode 61. When the deflector unit is moved in direction C by torque spring 37 the motor 36 acts as a generator to control the speed of the deflector unit. In that manner, the deflector unit is not allowed to accelerate to speeds which would damage the unit when it reaches stop positions.

Figure 6:
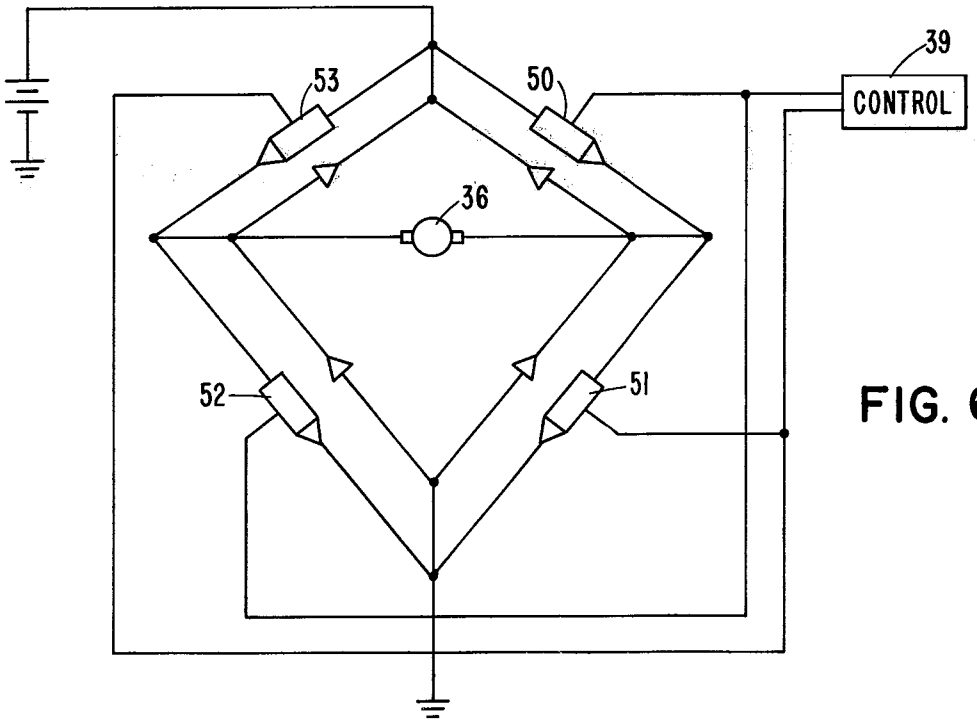
FIG. 6 is a circuit representation for supplying the incrementing motor to move the deflector unit in either direction.

Another embodiment of the invention is shown in the schematic circuit diagram of FIG. 6. Here, motor 36 can be enabled to move deflector unit 22 in either the incrementing direction B or the decrementing direction C. In this embodiment, torque spring 37 shown in FIG. 4 is eliminated, but otherwise the mechanism remains the same. In the circuit of FIG. 6, a control signal supplied from control unit 39 is applied to transistors 50 and 52 to energize motor 36 to move deflector unit 22 in a first direction. Control unit 39 closes transistor switches 51 and 53 to cause rotation of motor 36 in the second direction. Since the torque spring 37 is absent in this embodiment, it is desirable to maintain a small current energization of motor 36 to hold dog 32 against ratchet 31 when the deflector unit is positioned under a selected bin. This is accomplished by pulsing transistors 51 and 53.

Figure 7:
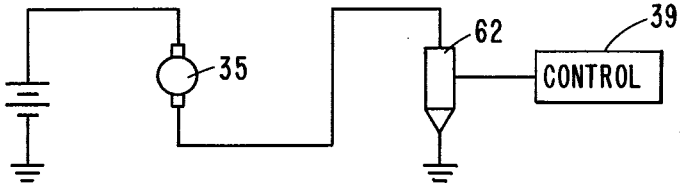
FIG. 7 is a circuit representation for supplying the feed motor.

FIG. 7 is an electrical schematic circuit showing motor 35 which drives the transport rolls of the deflector unit 22. This motor is operated at different speeds depending upon the number of pulses supplied to transistor switch 62 by the control unit 39 over a period of time. For example, while paper is in the fusing station 19 and 20 shown in FIG. 1, transport rolls 23 are operated at a speed synchronized to that of the fusing station so as not to scrub the copy paper and wear the rolls. However, when switch 25 senses that the copy paper is clear of the fusing station control 39 supplies additional pulses to transistor 62 so that a greater time average voltage is applied to motor 35 to increase the speed of the rolls 23.

In operation, the increment motor 36 drives the deflector unit 22 from bin 40 toward bin 49. The increment switch 34 makes and breaks as the unit 22 moves between bins, providing a bin count to the control unit 39.

When it is desired to move from bin 49 towards bin 40 the decrement solenoid 33 must be picked and the unit 22 is either spring biased by torque spring 37 to move towards bin 40 or motor 36 is energized in a reverse direction to move unit 22. When solenoid 33 is released, carriage 22 comes to rest in the next bin position under the influence of ratchet 31.

A collator empty switch 26 is provided in order to detect when bin 1 is empty. This is simply a control device to inform the operator to empty the collator before starting a new run.

When the collator is operated in the incrementing non-collate mode of the deflector unit 22 remains stationary under bin 40 until the proper number of sheets have been fed into the accessed bin, e.g., 15 sheets. The unit is then incremented to the next bin where an additional 15 sheets are fed into the bin. In a similar manner, the deflector unit 22 increments to succeeding bins until the desired number of copies have been produced. This procedure is used for simple copy production in a non-duplex, non-collate mode. It is also used on the first pass of a desired duplex output when copying from two-sided originals and also for the duplex output on a non-collate second pass.

The decrementing mode is enabled only when using a simplex input and producing a duplexed output and then only on the first pass of a copy run. At the beginning of the run, the collator is incremented to bin 49. Copies of the first pass of the first copied original are fed into bin 49. The deflector unit is then decremented to the next bin where copies of the third original are fed. In a similar manner the unit is decremented from bin 49 to bin 40 until the maximum allowable number of copies has been fed into bin 40. At this time further copy production is inhibited and the machine is stopped. The operator then removes the copies, places them in the copy paper bin, and enters the second pass of the duplexing operation.

When operating a collator in a normal collate mode the first copy of the first original is fed into bin 40, unit 22 is incremented to bin 41, and the second copy of the first original is placed in that bin. In a similar manner, the unit 22 increments to each bin for each produced copy until the last copy of the original on the document glass is fed into the corresponding collator bin. At this time unit 22 is returned to bin 40 for collation of copies of the next original. Collation may continue until 20 copies, for example, have been fed into each of the active collator bins. After the 20th copy is fed into the last active bin the collator unit 22 returns to bin 40 and the machine is turned off.

While the invention has been particularly shown and described with reference to a preferred embodiment thereof, it will be understood by those skilled in the art that the foregoing and other changes in form and details may be made therein without departing from the spirit and scope of the invention.

What is claimed is:

1. A self-contained deflector unit in a collator/sorter having a plurality of sheet-receiving bins, each opening along a path, said deflector unit being movable for selecting one of said bins, comprising:

a frame;

means mounting said frame for movement along said path, including frame moving means operable to move said frame into a plurality of feeding positions in proximity to the bin openings between an initial and a final position;

sheet transport means mounted on said frame for feeding sheets into said bins;

first electric motor means mounted on said frame for driving said sheet transport means;

second electric motor means mounted on said frame for driving said frame moving means to increment said deflector unit in a first direction to a position in feeding relationship to a selected bin; and decrementing motor means mounted on said frame for driving said frame moving means to decrement said deflector unit in a second direction to a position in feeding relationship to a selected bin, and said second electric motor means acts as a dynamic brake to control the speed of said deflector unit when moving in said second direction.

2. The deflector unit of claim 1 further comprising a collator increment switch means for providing n pulses whenever the deflector unit is moved n bin positions in either of the first or second directions.

3. The deflector unit of claim 2 wherein said second electric motor means is capable of moving said deflector unit n number of bin positions as sensed by said collator increment switch means and said decrementing motor means is capable of moving said deflector unit n bin positions.

4. The deflector unit of claim 3 wherein said decrementing motor means is a spring drive wound by said second electric motor means during movement of said unit in said first direction.

5. The deflector unit of claim 4 further comprising an actuator controllably releasing said decrementing motor during bin selection in said second direction to move said deflector unit to the selected bin.

6. The deflector unit of claim 1 wherein said first electric motor means drives said sheet transport means at a selected one of a multiplicity of speeds.

7. In a document copier machine, including processing stations such as imaging, developing and fusing stations, for feeding a sheet of finished copy to a collator/sorter having a plurality of vertically oriented bins, the improvement comprising:

a movable deflector unit in said collator/sorter for moving along a path to an opening in a selected one of said bins, said collator/sorter having a frame with sheet transport means mounted thereon for feeding sheets into said bins;

first electric motor means mounted on said frame for driving said sheet transport means at a plurality of speeds;

second electric motor means mounted on said frame for incrementing said deflector unit in a first direction to a position in feeding relationship to a selected bin;

decrementing motor means mounted on said frame for decrementing said deflector unit in a second direction to a position in feeding relationship to a selected bin; and means to determine when a sheet leaves the final of said processing stations for increasing the speed of said transport means from a first speed synchronized with the speed of said sheet through said machine to a second speed sufficient to provide a final upwardly directed impetus of said sheet into the bottom of said bins.

8. The improvement of claim 7 wherein said transport means is located at the bottom entrance of a selected bin and where the trailing edge of said sheet is in the final processing station simultaneously with the leading edge being gripped by said transport means.

9. The improvement of claim 8 further comprising a collator increment switch means for providing n pulses whenever the deflector unit is moved n bin positions in either of the first or second directions.

10. The improvement of claim 9 wherein said second electric motor means is capable of moving said deflector unit n number of bin positions as sensed by said collator increment switch means and said decrementing motor means is capable of moving said deflector unit n bin positions.

11. The improvement of claim 10 wherein said decrementing motor means is a spring drive wound by said second electric motor means during movement of said unit in said first direction.

12. The improvement of claim 11 wherein said second electric motor means acts as a dynamic brake to control the speed of said deflector unit when moving in said second direction.

13. The improvement of claim 7 wherein said decrementing motor means is said second electric motor means.

14. The improvement of claim 13 further comprising a collator increment switch means for providing n pulses whenever the deflector unit is moved n bin positions in either of the first or second directions.

15. The improvement of claim 14 wherein said second electric motor means is capable of moving said deflector unit n number of bin positions as sensed by said collator increment switch means and said decrementing motor means is capable of moving said deflector unit n bin positions.

* * * * *